United States Patent [19]

Kostylev et al.

[11] Patent Number: 4,776,407

[45] Date of Patent: Oct. 11, 1988

[54] CLAMPING ATTACHMENT TO A DEVICE FOR DRIVING ROD ELEMENTS OF LOW RIGIDITY INTO THE GROUND

[75] Inventors: Alexandr D. Kostylev; Boris B. Danilov; Boris N. Smolyanitsky; Alexei D. Terskov; Vladimir P. Boginsky; Jury N. Syryamin, all of Novosibirsk, U.S.S.R.

[73] Assignee: Institut Gornogo Dela Sibirskogo Otdelenia Akademii Nauk SSSR, Novosibirsk, U.S.S.R.

[21] Appl. No.: 897,396

[22] PCT Filed: Aug. 22, 1985

[86] PCT No.: PCT/SU85/00073

§ 371 Date: Jul. 2, 1986

§ 102(e) Date: Jul. 2, 1986

[87] PCT Pub. No.: WO86/03534

PCT Pub. Date: Jun. 19, 1986

[30] Foreign Application Priority Data

Dec. 5, 1984 [SU] U.S.S.R. ..... 3814901

[51] Int. Cl.[4] ..... E21B 1/00

[52] U.S. Cl. ..... 173/55

[58] Field of Search ..... 173/55, 163, 164

[56] References Cited

U.S. PATENT DOCUMENTS 4,205,727 6/1980 Smolyanitsky ..... 173/55

*Primary Examiner*—E. R. Kazenske
*Assistant Examiner*—Willmon Fridie, Jr.
*Attorney, Agent, or Firm*—Burgess, Ryan and Wayne

[57] ABSTRACT

A clamping attachment to a device for driving elongated rod elements of low rigidity into the ground comprises a housing (1) having a through tapered interior (2) and shoulders (7) on the outer surface. The interior (2) of the housing accommodates two spring-biased wedging elements (3) with slots (4). The slots (4) receive ends of arms (9) secured on the shoulders (7). Interposed between the spring (12) and wedging elements (3) is a washer plate (14). End faces (16, 17) of the wedging elements (3) and washer plate (14) are tapered. Contact surfaces (10, 11) of the slots (4,) and arms (9) are inclined to the longitudinal axis of the clamping attachment.

3 Claims, 1 Drawing Sheet

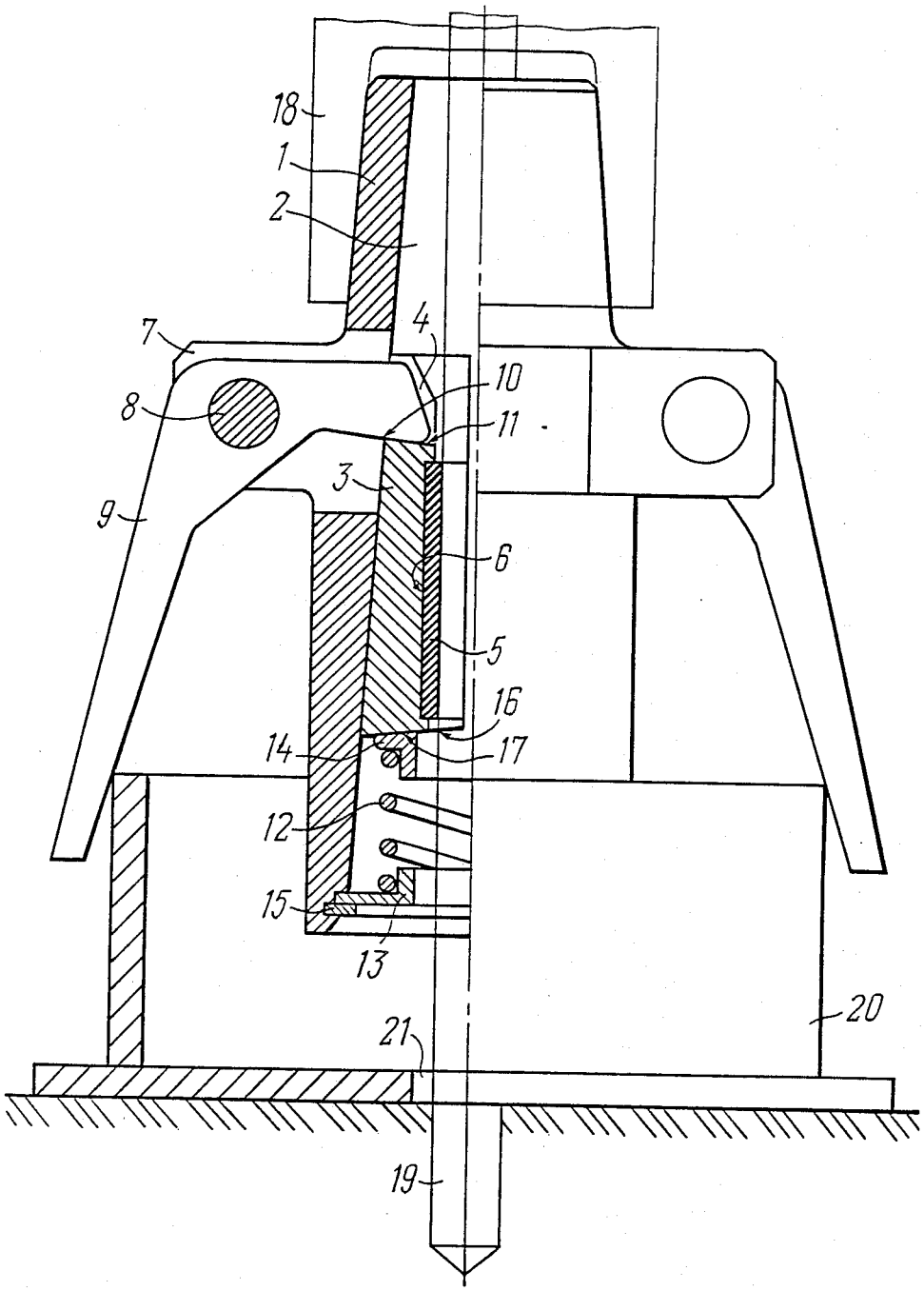
18
1
2
7
4
10
8
11
3
9
6
5
16
14
17
12
15
13
20
21
19

CLAMPING ATTACHMENT TO A DEVICE FOR DRIVING ROD ELEMENTS OF LOW RIGIDITY INTO THE GROUND

TECHNICAL FIELD

This invention relates to construction engineering, and more particularly to clamping attachments to devices for driving rod elements of low rigidity into the ground.

PRIOR ART

The practice widespread in most industrially developed countries is to drive into the ground rods provided with corrosion-resistant coatings. The volume of work associated with driving such rods into the ground is considerable with a trend for an increase.

Since a major condition for prolonged service life of rods envisages the lack of damage to corrosion-resistant coatings, the problem to be solved rests with designing such means for transmitting power from an impact power source to the rod being driven that would not damage the protective coating.

There is known a clamping attachment to a device for driving into the ground earthing electrode rods (cf., USSR Inventor's Certificate No. 376,525, IPC E 02 D 7/18) which comprises a housing having a through tapered interior made integral with a movable spring-loaded anvil. The interior of the clamping attachment accommodates wedging elements and a spring ensuring a contact of these elements with the housing of the clamping attachment and with the rod. The surfaces of the wedging elements engageable with the rod have sharp edges for power locking of the rod in the clamping attachment. The means for driving the rod into the ground is generally a percussive action device. Arranged coaxially with the main clamping attachment is an additional rodgripping means. The rod is passed through the additional rod-gripping means, hammer of the percussive action unit, and main clamping attachment until it bears on the ground. In the course of its travel along the rod the hammer of the percussive action unit delivers impacts on the movable anvil, whereby the rod is jammed in the clamping attachment to travel therewith downwards. Concurrently, the spring is compressed, and when the hammer ascends to deliver a successive impact, the spring acts to raise the anvil with the clamping attachment to the initial position.

Inherent in the aforedescribed clamping attachment construction is insufficient strength of the movable anvil made integral with the housing of the arrangement and adapted to take up off-center impact loads. Also, as the rod penetrates deeper into the ground, it becomes necessary to slide the clamping attachment upwards and fix it at a higher level, which results in lateral notches on the rod caused by the sharp edges to provoke damage of the protective coating of the rod surface and make it more susceptible to corrosion.

There is also known a clamping attachment to a device for driving into the ground rod elements of low rigidity (cf., e.g., U.S. Pat. No. 4,205,727, IPC E 21 B 1/02) which comprises a housing having a through tapered interior and shoulders on its outer surface, spring-loaded wedging elements with grooves or slots on their outer surface accommodated in the tapered interior of the housing, and arms secured in pins on the shoulders of the housing and having their ends received by the slots of the wedging elements. Provided at the other surface of the wedging elements in contact with the rod are sharp edges for power locking the rod in the clamping attachment. This prior art clamping attachment can be rigidly coupled with a percussive air-operated mechanism having a through axial passage, as illustrated in another U.S. Pat. No. 4,160,486, IPC E 21 B 1/02.

The rod to be driven into the ground is inserted from above into the axial passage of the percussive action air-operated mechanism to be passed therethrough until in contact with the ground surface. While holding the rod in the required position, the clamping attachment and the percussive action mechanism are raised to a height of 0.5 to 0.7 m above the ground level. The wedging elements are forced by the spring to assume the topmost position until they engage the rod by their sharp edges. Under the action of impacts delivered by the percussive action air-operated mechanism and imparted to the clamping attachment rigidly affixed thereto the rod is jammed in the clamping attachment thus driven into the ground. When the clamping attachment is brought closer to the ground level it is caused to unclamp to ensure an upward travel of the percussive air-operated mechanism along the rod thanks to the action of reactive recoil forces, which is followed by a subsequent power locking of the rod in the clamping attachment. Such a successive upward displacement of the percussive air-operated mechanism results in numerous lateral cuts and notches on the rod damaging corrosion-resistant coating and making the rod surface more susceptible to corrosion.

Another disadvantage of the aforedescribed clamping attachment resides in that the sharp edges of the wedging elements tend to wear and become blunt to result in reduced depth of their penetration into the rod, less efficient friction in the zone of contact and less reliable power locking of the clamping attachment. Therefore, the clamping attachment tends to slip downwards on the rod under the action of impact loads being applied thereto. As the edges wear out, they may lose their capacity to cut into the rod, and since the friction coefficient of steel is low, the force of friction in the area of contact between the wedging elements and the rod may become insufficient for power locking of the entire system (viz., housing of the clamping attachment—wedging element—rod).

Therefore, when impact loads are applied to the clamping attachment, it tends to slip relative to the rod, whereby the rod fails to be driven into the ground.

In view of the foregoing, the above disadvantages confine the field of application of the prior art clamping attachments and devices for driving rod elements into the ground and effect their reliability.

ESSENCE OF THE INVENTION

It is the main object of the present invention to provide a clamping attachment ensuring driving rod elements provided with protective, such as corrosion-resistant, coatings, into the ground without damaging thereof as well as to ensure a more reliable power locking of the rod element in the clamping attachment.

This object is attained by that in a clamping attachment to a device for driving into the ground elongated rod elements comprising a housing having a tapered interior and shoulders on its outer surface, at least two spring-loaded wedging elements with slots secured in the tapered interior, the slots receiving ends of the arms pivotably secured on the shoulders of the housing, according to the invention, there is provided a washer plate interposed between the spring and wedging elements, the end faces of the wedging elements and washer plate being tapered, whereas the contact surfaces of the slots of said wedging elements and those of the arms are inclined to the longitudinal axis of the clamping attachment, surfaces of the wedging elements bracing the rod having friction linings.

The aforedescribed arrangement of the clamping attachment makes it possible to drive into the ground rod elements having protective coating without damaging the coating integrity, while ensuring reliable power locking of the rod in the clamping attachment.

Preferably, the friction linings are placed in recesses provided at the inner surface of the wedging elements, which affords reliable attachment of the friction linings to the inner surface of the wedging elements to result in their longer service life.

Preferably, the slots of the wedging elements are through slots.

Such a construction of the slots makes the wedging elements easier to fabricate.

The essence of the present invention resides in as follows.

Impact load is transmitted to the rod by virtue of friction forces arising at the point of contact between the wedging element and the rod. These friction forces depend largely on the inclination angle of the generating line of the tapered interior of the housing, as well as on the type of contact between the wedging element and the rod and the materials of the wedging element and the rod. The use of friction linings at the surfaces of the wedging elements embracing the rod provides, under the action of impact loads, power locking of the system "housing of the clamping attachment—wedging elements—rod" by virtue of static friction. In addition, such power locking, in contrast to the use of sharp edges, prevents damage to the rod surface.

The use of a washer plate disposed between the spring and wedging elements, and the tapered configuration of the end faces of the washer plate and wedging elements, as well as the inclination of the contact surfaces of the slots of the wedging elements and those of the arms to the longitudinal axis of the proposed clamping attachment, induce a contact of the wedging elements with the housing during unlocking of the clamping arrangement and facilitate rearrangement of the percussive air-operated unit upwards on the road as the latter is driven into the ground.

In view of the aforedescribed, the clamping attachment embodying the present invention allows to efficiently and reliably transmit impact to the rod without damaging its surface to result in longer service life of the proposed clamping attachment.

SUMMARY OF THE DRAWINGS

The invention will now be described in greater detail with reference to a specific preferred embodiment thereof taken in conjunction with a sole FIGURE of the drawings, in which there is shown a general view of a clamping attachment to a device for driving elongated rod elements into the ground.

PREFERRED EMBODIMENT OF THE INVENTION

The clamping attachment comprises a housing 1 having a through tapering interior 2 in which there are disposed wedging elements 3 with through slots 4 in the top portion and friction linings 5. The friction linings 5 are placed in recesses 6 made at the inner surfaces of the wedging elements 3. Shoulders 7 are provided at the outer surface of the housing 1 to hold on pins 8 arms 9 with ends thereof received by the slots 4. Contact surfaces 10 and 11 of the arms 9 and slots 4 are inclined to the longitudinal axis of the proposed clamping arrangement. The wedging elements 3 are urged toward the arms 9 and housing 1 by a spring 12 secured between a flange 13 of the housing 1 and washer plate 14. The flange 13 closes the tapered interior 2 of the housing 1 and is fixed therein by means of a retaining ring 15. End faces 16 and 17 of the wedging elements 3 and washer plate 14 are tapered. The clamping arrangement is received by a tapered seat of a percussive action unit indicated at 18. A release sleeve 20 having a central hole 21 is provided at the point where a rod 19 is driven into the ground.

The clamping attachment according to the invention operates in the following manner.

The percussive action unit 18 with the proposed clamping attachment received by its tapered socket is positioned vertically so that the arms 9 would bear on the release sleeve 20. Under the action of the force of gravity of the percussive action unit 18 the arms 9 tend to swivel about the pins 8 to act on the surface 11 of the slot 4 and move the wedging elements 3 downwards, as well as compress the spring 12. Because the contact surfaces 10 and 11 of the arms 9 and slots 4 are inclined relative to the axis of the clamping attachment, while the end faces 16 and 17 of the wedging elements 3 and washer plate 14 are tapered, on their downward travel the wedging elements 3 are drawn apart to be pressed to the side surface of the through tapered interior 2 of the housing 1. Such an action results in an increase in the passage area between the wedging elements 3.

The rod 19 is inserted from above into the percussive action unit 18 and into the clamping attachment to pass therethrough and through the release sleeve 20 until it is in contact with the ground. Since the wedging elements 3 are forced to the side surface of the tapered interior of the housing 1, the rod 19 passes freely therethrough without interfering with the linings 5. By retaining the rod 19 in the required position the percussive action unit is elevated to a height of 0.5 to 0.7 m from the ground level. Therewith, the wedging elements 3 of the spring 12 assume their topmost position to be brought into contact with the housing 1 and rod 19. Under the section of the force of gravity of the percussive action unit 18 the clamping attachment becomes reliably secured on the rod 19. When the percussive action unit is actuated, its hammer delivers impacts on its housing imparted to the clamping attachment rigidly secured thereto, whereby the housing 1 of the proposed clamping attachment tends to move downwards. On its downward travel it slips to the wedging elements 3 to force them to the rod 19. Conversely, recoil forces from the working chambers of the percussive action unit act to move the housing 1 upwards to unlock the clamping attachment. However, the forces necessary for unlocking the proposed attachment exceed in magnitude the recoil forces, because the cone angle of the tapered interior 2 is less than the wedge self-locking angle, whereby no arbitrary release or unclamping of the clamping arrangement occurs.

Under the action of the impacts the rod 19 is driven into the ground. Upon the arms 9 of the clamping attachment being brought closer to the ground surface, these arms 9 bear on the release sleeve 20 resting on the ground level to pivot about the pins 8 during a further travel of the rod 19 inside the ground. Acting by its contact surface 10 on the contact surface 11 of the wedging element 3 the arm 9 shifts it downwards. Due to the contact surfaces 10 and 11 being inclined to the vertical axis of the proposed clamping attachment, and due to the fact that the end faces 16 and 17 of the wedging elements 3 and washer plate 14 are tapered, these wedging elements 3 are drawn apart on their travel downwards to press against the housing 1 and form a space between these and the rod 19. At the point of unlocking of the clamping attachment the percussive action unit 18 moves under the action of recoil forces upwards along the rod 19 until the hammer of the percussive action unit 18 delivers a successive impact to again engage the clamping attachment and wedge the rod 19 therein.

Thereafter, the aforedescribed cycle is repeated until the rod is completely immersed in the ground.

In this manner the clamping attachment to a device for drtiving rod elements of low rigidity into the ground makes it possible to immerse into the ground such rod elements without damaging their protective coatings thanks to the provision of the wedging elements with friction linings to thus assure reliable power clamping of the rod in the clamping attachment by virtue of static friction, which, as is known, is greater in magnitude than sliding friction, whereby the protective coating of the rod is not susceptible to damage. In addition, wear of the friction linings does not result in operational failure of the proposed clamping attachment, nor does such wear affect its capacity to slip along the rod, since the friction coefficient is not dependent on the extent of lining wear.

In contrast to the prior art clamping attachments for driving rod elements of low longitudinal rigidity, the proposed attachment affords a longer life of rods provided with protective, such as corrosion-resistant, coatings.

INDUSTRIAL APPLICABILITY

The attachment embodying the present invention can find application for driving elongated rod elements into the ground. The proposed attachment is especially efficient for driving into the ground rod elements of low longitudinal rigidity, such as grounding electrodes, tie rods, well points, and the like.

What is claimed is:

1. In a clamping attachment for a device for driving, into the ground, elongated rod elements of low rigidity comprising, a housing (1) having a tapered passage (2) and shoulders (7) arranged on the exterior of the housing; at least a spring and at least two spring-biased wedging elements (3), having slots with contact surfaces (4), secured inside the passage (2); arms (9) with ends received by the slots (4) and engaging contact surfaces of the slots, said arms pivotally arranged on the shoulders (7) of the housing (1), the improvement which comprises: a washer plate (14) interposed between the spring (12) and wedging elements (3), the end faces (16,17) of the wedging elements and the washer plate (14) adjacent to each other being inclined; contact surfaces (10,11) of the slots (4) of said wedging elements (3) and contact surfaces of the arms (9) being inclined to the longitudinal axis of the clamping attachment, the inclination of the adjacent end faces of the wedging elements and the washer plate, and the inclination of the contact surfaces of the slots and arms is in a direction to urge the wedging elements away from the rod element when the arms apply a force to the contact surfaces of the slots, and wherein surfaces of the wedging elements (3) which embrace the rod (19) comprises friction linings (5).

2. A clamping attachment of claim 1, wherein the friction linings (5) are arranged in recesses (6) provided on the surface of the wedging elements (3), adjacent to the rod element.

3. A clamping attachment of claim 1, wherein the slots (4) of the wedging elements (3) extend from the outside to the inside of the elements.

* * * * *